United States Patent [19]

Loose et al.

[11] Patent Number: 5,046,320

[45] Date of Patent: Sep. 10, 1991

[54] LIQUID REFRIGERANT TRANSFER METHOD AND SYSTEM

[75] Inventors: George R. Loose, Bridgeton, N.J.; Robert S. Michny, Morris, Pa.

[73] Assignee: National Refrigeration Products, Plymouth Meeting, Pa.

[21] Appl. No.: 477,681

[22] Filed: Feb. 9, 1990

[51] Int. Cl.[5] ..... F25B 45/00

[52] U.S. Cl. ..... 62/77; 62/292

[58] Field of Search ..... 62/292, 92, 77, 149, 62/145

[56] References Cited

U.S. PATENT DOCUMENTS

| | | | |
|---|---|---|---|
| 3,232,070 | 2/1966 | Sparano . | |
| 4,285,206 | 8/1981 | Koser . | |
| 4,363,222 | 12/1982 | Cain . | |
| 4,476,688 | 10/1984 | Goddard . | |
| 4,480,446 | 11/1984 | Margulefsky et al. . | |
| 4,766,733 | 8/1988 | Scuderi . | |
| 4,809,515 | 3/1989 | Houwink . | |
| 4,856,289 | 8/1989 | Lofland . | |
| 4,856,290 | 8/1989 | Rodda | 62/292 X |
| 4,934,390 | 6/1990 | Sapp . | |
| 4,938,031 | 7/1990 | Manz et al. . | |

*Primary Examiner*—Henry A. Bennett

*Attorney, Agent, or Firm*—Panitch Schwarze Jacobs & Nadel

[57] ABSTRACT

A liquid refrigerant transfer system includes a low-pressure liquid refrigerant pump coupled by drain hoses between a refrigeration system liquid refrigerant service or drain fitting and a liquid refrigerant storage tank. Another hose couples the refrigerant storage tank with a vapor refrigerant service or fill fitting of the refrigeration system. Preferably, a quick disconnect coupling is provided at least between the drain hose and the refrigerant storage tank to facilitate the removal of the filled tank and the substitution of a second, empty tank to continue the transfer. The vent hose carries liquid refrigerant vapor and any liquid refrigerant overflow back into the refrigeration system, thereby permitting substantially unattended use of the system. The system can be used to transfer liquid refrigerant back from the storage tank back into the refrigeration system through the drain opening.

9 Claims, 2 Drawing Sheets

LIQUID REFRIGERANT TRANSFER METHOD AND SYSTEM

FIELD OF THE INVENTION

The invention relates to liquid refrigerant transfer and, in particular, to a simple system for accomplishing the same, particularly in commercial and industrial applications involving the transfer of hundreds and even thousands of pounds of low-pressure liquid refrigerant.

BACKGROUND OF THE INVENTION

It is often desirable and even necessary to drain liquid refrigerant from commercial and industrial refrigeration systems for repair, refurbishment or removal of such systems. Commercial and industrial sized systems often have a liquid refrigerant capacity of hundreds to thousands of pounds. Previously, liquid refrigerants were simply drained or pumped into open containers permitting spillage of the refrigerant and essentially unrestricted release of the refrigerant vapors.

More recently, with knowledge of its potential for harm to the environment, liquid refrigerant recovery systems have been introduced by several suppliers. However, such systems have tended to be quite complicated including components for refurbishing the liquid refrigerant and through which the refrigerant must be passed itself. Such systems often employ compressors, heavy filters and/or distillers. While such systems might be cart mountable, they tend to be cumbersome and heavy. In many instances, there is simply no need to refurbish the refrigerant. Instead, all that is needed is to remove the liquid refrigerant from the system quickly, to prevent its contamination or continuous venting into the atmosphere, while the unit is repaired.

SUMMARY OF THE INVENTION

In one aspect, the invention is a method of environmentally safely transferring liquid refrigerant between a closed refrigeration system and a transportable, liquid refrigerant storage container, the refrigeration system including a drain valve and drain fitting located below a normal level of liquid refrigerant in the system and a fill valve and fill fitting located above the normal level of liquid refrigerant in the system. The liquid refrigerant storage container includes at least two separate fittings providing separate access to the container interior. The method comprises the initial step of sealingly coupling a liquid refrigerant pump between the drain fitting and one of the two storage container fittings through drain hosing, sealingly coupling the remaining one of the two storage container fittings and refrigeration system fill fitting through vent hosing and opening the system drain and fill valves. The method next comprises the step of activating the pump to transfer low-pressure liquid refrigerant from the system through the drain hosing into the storage container. I0 Lastly, the method further comprises the step of conducting refrigerant vapor and any liquid refrigerant overflow from the storage container back to the refrigeration system through the vent hosing.

In another aspect, the invention is a low-pressure liquid refrigerant transfer kit comprising: a low-pressure refrigerant liquid pump having inlet and outlet fittings and first, second and third hoses. The kit further comprises first means for coupling a first end of the first hose with one of the two pump fittings and second means for coupling a second end of the first hose with a refrigeration system female pipe threaded liquid refrigerant service fitting. The kit further comprises third means for coupling a first end of the second hose with the remaining one of the two pump fittings and fourth means for coupling the second end of the second hose with a first female pipe threaded opening in a transportable liquid refrigerant storage container. The kit further comprises fifth means for coupling a first end of the third hose with a second female pipe threaded opening in a transportable liquid refrigerant storage container and sixth means for coupling the second end of the third hose with a refrigeration system female pipe threaded vapor refrigerant service fitting.

BRIEF DESCRIPTION OF THE DRAWINGS

The foregoing summary, as well as the following detailed description of the presently preferred embodiments of the invention, will be better understood when read in conjunction with the appended drawings. It should be understood, however, that the invention is not limited to the precise arrangements illustrated. In the drawings.

DETAILED DESCRIPTION OF THE EMBODIMENTS

Figure 1:
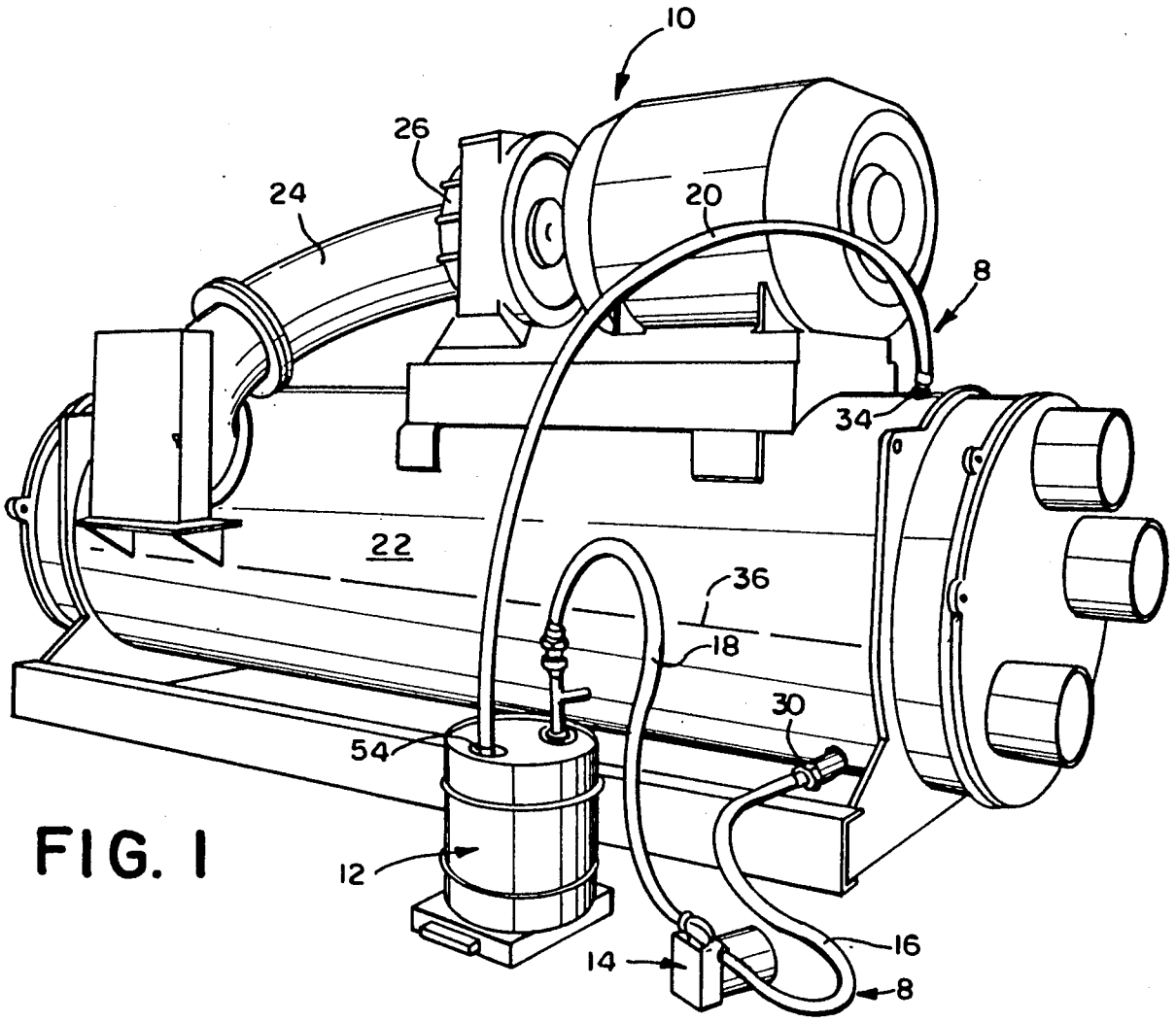
FIG. 1 depicts a liquid refrigerant transfer kit of the present invention installed and transferring liquid between a large refrigeration unit and a portable liquid refrigerant storage container.
Figure 2:
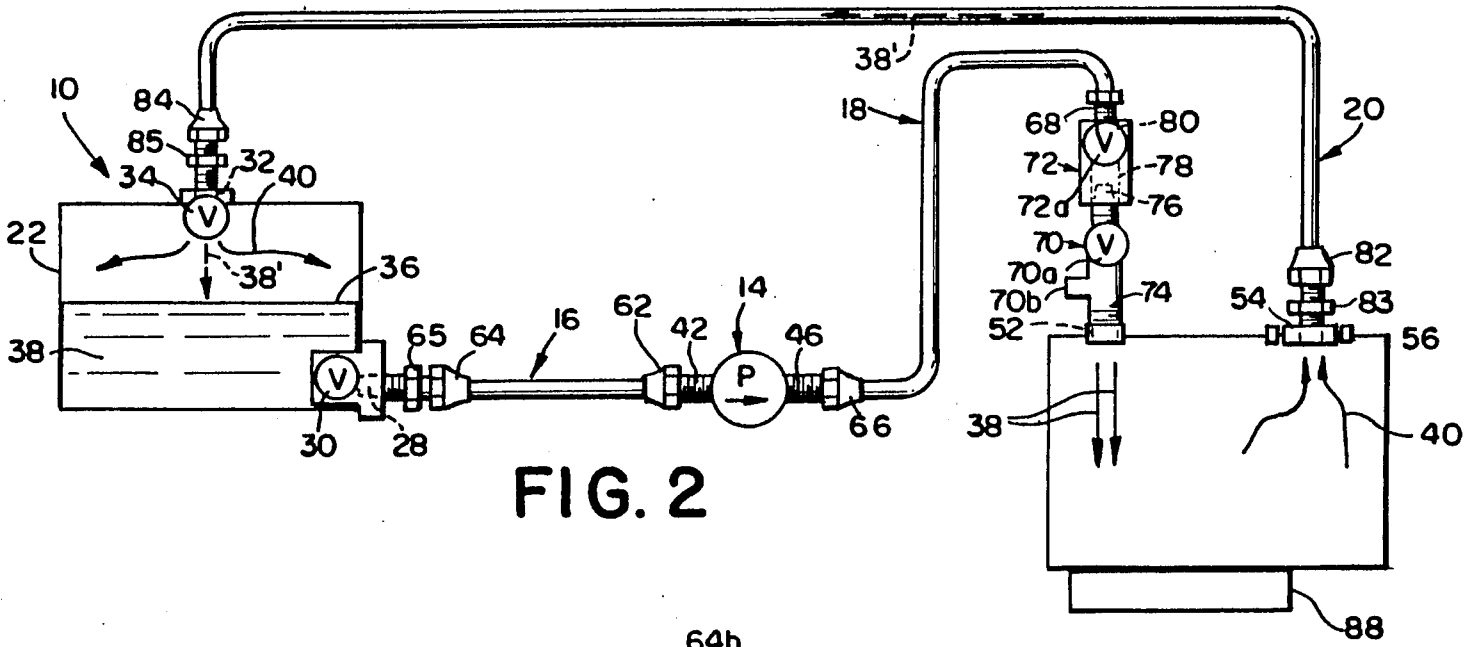
FIG. 2 is a block diagram of the refrigerant liquid transfer kit of FIG. 1 depicting the transfer of liquid refrigerant from the refrigeration system to the refrigerant storage tank.

FIGS. 1 and 2 depict a preferred, portable, liquid refrigerant transfer system, indicated collectively at 8, which can be hand carried by a technician as a service kit. The system 8 is designed for transfer of R-11 or R-113 CFC low-pressure liquid refrigerants between larger low-pressure centrifugal refrigeration units, a representative one of which is depicted and indicated generally at 10, and smaller portable, liquid refrigerant containers or drums, one of which is indicated at 12. The preferred system 8 includes a portable, hand carried liquid refrigerant pump 14 and first, second and third hoses 16, lS and 20, respectively. The refrigeration system 10 includes a liquid refrigerant tank 22 on a low-pressure side of the system 10, coupled through conduit 24 to a compressor 26. Tank 22 is normally partially filled with liquid refrigerant to a level indicated by broken and solid lines 36 in FIGS. 1 and 2, respectively. Low-pressure liquid refrigerant is boiled in the tank 22 and drawn off in the compressor 26 for pumping into a high-pressure side of the system 10 (not depicted).

Conventional commercial and industrial sized low-pressure refrigerant systems 10 are provided with a "drain" fitting and valve 28 and 30, respectively, also referred to more specifically as liquid refrigerant service fitting and valve, respectively. Valve 28 and fitting 30 are located below the normal level 36 of liquid refrigerant in tank 22 of system 10, and specifically at the bottom of tank 22. Such systems 10 are also provided with a "fill" fitting and valve 32 and 34, respectively, also referred to more specifically as a vapor refrigerant service fitting and valve, respectively, which are located above the normal level 36 of liquid refrigerant in tank 22 of the system 10, specifically at the top of tank 22.

Preferably, the system 8 is intended to be used with standard, American Refrigeration Institute specified, transportable, low-pressure liquid refrigerant storage containers 12, suitable for storing R-11 and R-113 CFC low-pressure refrigerants. Such containers 12 include a first, three-quarter inch female pipe threaded opening 52 and a second two-inch diameter female pipe threaded opening receiving a two-inch diameter male pipe threaded plug 54. The plug 54 itself includes a three-quarter inch female pipe threaded opening 56.

Referring to FIG. 2, preferably, each of the hoses 16, 18 and 20 is three-quarter inch diameter and made of nitrile rubber, preferably acrylonitrile butadiene rubber, to resist deterioration from contact with the R-11 and/or R-113 refrigerant. The pump 14 is preferably a centrifugal design with an impeller powered by 115 volt alternating current electric motor. The pump 14 preferably is provided with a standard three-quarter inch flare threaded inlet fitting 42 and a standard, three-quarter inch flare threaded outlet fitting 46. Preferably, both pump fittings 42 and 46 are male fittings for reasons that will become apparent. The first hose 16 preferably includes a three-quarter inch flare threaded female swivel fitting 62 at one end to mate with the pump inlet male fitting 42 and a three-quarter inch flare threaded female swivel fitting 64 for mating with a three-quarter inch female pipe threaded drain fitting 28 typically provided in industrial and commercial sized refrigeration units sold and installed in the United States, through a male/male flare thread/pipe thread adaptor 65. The second hose 18 preferably has a standard three-quarter inch flare threaded female swivel fitting 66 at a first end for coupling with the outlet fitting 46 of pump 14. The second end of the second hose 18 preferably has a pipe threaded male fitting 68. The system 8 preferably further includes a quick disconnect coupling provided by male and female members 70 and 72, respectively. Member 70 has the standard three-quarter inch male pipe threads 74 at one end for coupling with one opening 52 of the storage container 12. Opening 52 becomes the fill/feed opening of the container 12. The second, opposing end of the member 70 is preferably provided with a standard, male quick disconnect fitting 76 which is received in and mates with a compatible female quick disconnect fitting 78 in member 72. The other end of member 72 has a standard three-quarter inch female pipe threaded opening 80 to receive fitting 68. A handle **70*b* can be provided on the male member 70 to assist threading the pipe threaded end 74 into opening 52 of the storage container 12**.

The third hose 20 is preferably provided at either end with standard three-quarter inch flare threaded female swivel fittings 82 and 84. The second fitting 84 is coupled with female pipe threaded fill or vapor service fitting 32 typically provided on such units 10, through a male/male flare threaded/pipe threaded adaptor 85. The first fitting 82 is coupled with the second opening 56 of the container 12 which becomes the vent opening through another male/male flare threaded/pipe threaded adaptor 83. The container 12 is preferably placed on a scale 88 so that the weight of the container 12 may be monitored to determine when the container 12 is substantially full (or empty) of liquid refrigerant.

The components of the liquid refrigerant transfer system 8 can be substantially conventional components designed for liquid water transfer. However, suitable materials should be used for or substituted for all refrigerant contact elements. Thus, for example, the pump 14 may be a standard, electrically driven centrifugal water pump having suitable metal and/or plastic liquid refrigerant contact components. Aluminum and ABS are, for example, suitable metal and plastic materials for use with R-11 and R-113 liquid refrigerants. Any liquid refrigerant contacting gaskets or seals in the pumps 14 should be made of Buta N (nitrile rubber), polytetrafluoroethylene (PTFE), or other suitable liquid refrigerant contact material. The pump may be, for example, a Model PC4 portable electric centrifugal utility pump of Wayne Home Equipment, Ft. Wayne, IN, in which nitrile rubber seals are substituted. The quick disconnect coupling provided by members 70 and 72 may be a standard water coupling modified as outlined above by the substitution of nitrile rubber and/or PTFE, where appropriate, for other rubber or elastomer materials. The quick disconnect, may be, for example, a model BH6-60-111 coupling made by Parker Hanifin, Minneapolis, Minn. in which nitrile rubber and/or PTFE components are substituted.

Use of the liquid refrigerant transfer system is best explained with reference to FIG. 2 which depicts in block diagram form the refrigeration system 10, storage container 12 and liquid refrigerant transfer system 8 depicted in FIG. 1 for transfer of liquid refrigerant from the system 10 to the tank 12. The refrigerant system 10 with which the kit 8 is intended to be used is a conventional, closed, low-pressure, centrifugal refrigeration, air-conditioning or heat pump unit using R-11 or R-113 CFC low pressure refrigerant. Liquid refrigerant in tank 10 is indicated at 36. Gaseous refrigerant is indicated by wavy arrowed lines 40. The normal level of liquid refrigerant in the system 10 tank 22 is indicated by line 36.

Preferably, adaptors 65 and 85 are mounted to the female pipe threaded drain and fill fittings 30 and 32 and member 70 and adaptor 83 mounted to the container 12 in openings 52 and 56. Member 72 is threaded to fitting 68 if not already so mounted. First ends of the first and second hoses 16 and 18 are secured through their flare end fittings 62 and 66 to the inlet and outlet fittings 42 and 46, respectively, of the pump 14. The remaining end 64 of hose 16 is sealingly coupled with the drain fitting 28 while the members 70 and 72 are joined, thereby sealingly coupling the liquid refrigerant pump 14 between the drain fitting 28 and the storage tank fill fitting 52 through the hoses 16 and 18 which together constitute the drain hosing. Importantly, the pump 14 is directly connected between the system 10 and the container 12 so there are no intermediate filtering, distilling or other apparatus which would reduce the maximum refrigerant transfer rate of the pump 14. The third hose 20 constitutes vent hosing sealingly coupling the container 12 vent fitting 56 with the refrigeration system fill or vapor service fitting 32. The system drain valve 30 and fill valve 34 are opened. If separate valves are provided at the storage container fill opening or vent openings 52 or 56, those are to be opened as well before the system valves 30 and 34. The pump 14 is then activated to transfer liquid refrigerant 38 from the system 10 to the container 12 through the drain hoses 16 and 18. At the same time, refrigerant vapor 40, which builds up in the container 12 as the container fills with liquid refrigerant 38, and liquid refrigerant, should the container be filled with liquid, pass through vent hose 20 back to the system 10. Filling of the container 12 can be monitored through the scale 88.

One of the major benefits of the system 8 is that it requires minimal rather than close supervision. If the pump 14 is left running to overfill the container 12, liquid refrigerant overflow, indicated by phantomed 10 arrowed straight line 38', is carried by the vent hose 20 back into the system 10. When the container 12 is filled, it is removed and replaced. Removal and replacement is simplified by the quick disconnect coupling members 70, 72. Preferably, each member 70 and 72 of the quick disconnect coupling includes an internal spring loaded check valve **70*a* and 72*a*, respectively. Each valve 70*a* and 72*a* opens when the members 70 and 72 are joined and each closes when the members are separated. Thus, in ordinary circumstances, when the container 12 is substantially filled to capacity, the pump 14 is deactivated, the hose 18 disconnected from the container 12 through the quick disconnect coupling members 70 and 72, the member 70 unscrewed from the container 12 with handle 70*b* and installed in a second, empty liquid refrigerant storage container (not depicted). The third hose 20 is removed from the container by separating adaptor 83 from hose 18 and container 12. Typically, three-quarter inch plugs or bolts are threaded into the openings 52 and 56 to seal container 12. Hoses 18 and 20 are coupled in the same way to a second temporary storage container and the pump 14 reactivated to continue the transfer of liquid refrigerant 38 from the system 10 to the second container. The process continues until the system 10 is drained of all recoverable liquid refrigerant 38. The system 10** may then be repaired, refurbished or removed.

If it is desired to refill the system 10, the pump 14 can be reversed between the first and second hoses 16 and 18 such that hose 16 is coupled with the outlet of the pump 14 while the second hose 18 is coupled with the inlet of the pump 14. The use of male flare threaded fittings 42 and 46 with female flare threaded swivel fittings on the ends of hoses 1 6 and 1S make the reversal of pump 14 relatively quick and easy. The remaining couplings remain the same. When the pump 14 is activated, liquid refrigerant 38 is drawn from the storage container 12 and pumped into the system 10 through the drain opening fitting 28. Refrigerant vapor displaced in the system 10 from the liquid refrigerant 38 is carried back to the container 12 through the third hose 20. It may be necessary to lay container 12 on its side to present the liquid refrigerant at opening 52 and to completely invert the container 12 to empty it entirely of liquid refrigerant.

The present system provides significant versatility over more complex reconditioning systems typically used for liquid refrigerant transfer today. The various hoses 16, 18 and 20 can be provided in lengths of eight feet, fifteen feet and fifteen feet, respectively, with all fittings, couplings and adaptors at a total weight of about twenty pounds or less, while the pump 14 can be provided at a weight of about fifteen pounds or less. This makes the entire system 8 at least ten percent lighter than the best known previous transfer systems. The previously identified pump is capable of transferring liquid refrigerant at rates of up to thirty pounds per minute. The overall relatively light weight of the system 8 and relatively equal weight between the pump and the hoses permit the system to be easily carried by a single technician as a kit. The automatic overflow protection further permits virtually unattended use, allowing the technician to work on other tasks while the system is draining without fear of a refrigerant spill. By using or modifying standard water fittings, couplings, adaptors and pumps, which are widely available in a variety of configurations, prices and performances, the design and original manufacture costs of the system 8 have been greatly reduced. If desired, a second set of quick disconnect members 70 and 72 can be provided between the third hose 20 and the container 12 to permit full sealing of system 10 and container 12 when disconnection is made from the container 12. This would permit, for example, in the case of overflow of the container 12, the raising of hose 20 to drain all liquid refrigerant trapped in the hose 20 back into the system 10, further diminishing the likelihood and extent of refrigerant spills and venting.

Figure 3:
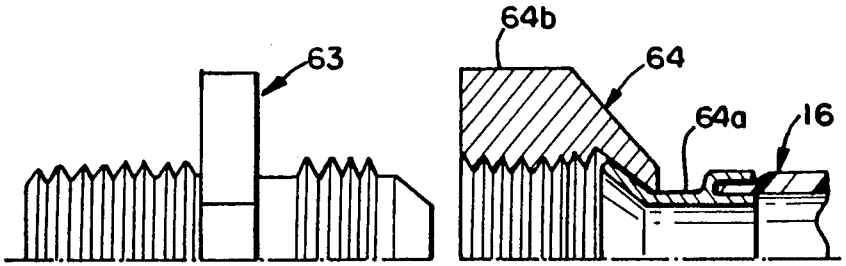
FIG. 3 depicts diagrammatically in longitudinal quarter section, a swivel mounted female flare threaded fitting and male/male, flare threaded/pipe threaded adaptor.

The use of male/male adaptors to permit the use of female flare threaded swivel mounted fittings is very helpful. They permit the hoses to be easily disconnected without twisting. As seen in FIG. 3, typical swivel fitting 64 includes, for example, a flared seat **64*a* fixedly secured by conventional suitable means to an end of nitrile hose 16 and a female threaded member 64*b* swiveling on seat 64*a***.

The described hose fittings of the transfer system 8 have been selected to provide direct and immediate quick connection to the greatest number of industrial and commercial refrigeration systems. However, there are no industry standard connections for all refrigeration systems 10 and all possible storage containers 12. Therefore, it will be appreciated that various other adaptors, particularly size adaptors, may be beneficially provided to assure connectability in all or at least nearly all possible service situations.

One of ordinary skill will appreciate that the female fitting 62 constitutes first means for coupling the first end of hose 16 with either of the pump inlet and outlet male flare threaded fittings 42 and 46, that coupling 64 and adaptor 65 collectively constitute second means for coupling the second end of the first hose 16 with the liquid refrigerant female pipe threaded service fitting 28, that fitting 66 constitutes third means for coupling a first end of the second hose 18 with either fitting 42 and 46 of the pump 14, that fitting 68 and quick disconnect members 70 and 72 together collectively constitute fourth means for coupling the second end of the second hose 18 with either threaded opening 52 or 56 of container 12, that fitting 82 and adaptor 83 constitute fifth means for coupling the first end of the third hose with the second female pipe threaded opening 56 and 52 in the container 12 and that fitting 84 and adaptor 85 collectively constitute sixth means for coupling the second end of the third hose 20 with the refrigeration system female pipe threaded vapor refrigerant service fitting 32. Of course, other combinations are possible.

While three-quarter inch fittings, adaptors and hoses are preferred for mating use with larger refrigeration units, which benefit more from the use of this system and method, those of ordinary skill would know that the described kit components can be supplied in different sizes for use with smaller refrigeration systems typically employing smaller hoses, valves and fittings.

It will be recognized by those skilled in the art that changes may be made to the above-described system and method for transferring liquid refrigerant. Accordingly, reference should be made to the appended claims.

rather than to the foregoing specification, as indicating the scope of the invention.

We claim:

1. A method of environmentally safely transferring low-pressure liquid refrigerant between a closed refrigeration system and a transportable, liquid refrigerant storage container, the refrigeration system including a drain valve and drain fitting located below a normal level of liquid refrigerant in the system and a fill valve and fill fitting located above the normal level of liquid refrigerant in the system, the liquid refrigerant storage container including at least two separate fittings providing separate access to the container interior, comprising the steps of:

sealingly coupling a liquid refrigerant pump between the drain fitting and one of the two storage container fittings through drain hosing, the drain hosing including at an end proximal the storage container one of a pair of mating, quick disconnect fittings of a quick disconnect coupling, the drain hosing further including a shut-off valve in the one quick disconnect fitting, the valve closing automatically when the pair of mating quick disconnect fittings are uncoupled, sealingly coupling the remaining one of the two storage container fittings and the refrigeration system fill fitting through vent hosing, and opening the system drain and fill valves;

activating the pump to transfer low-pressure liquid refrigerant from the system through the drain hosing into the storage container;

conducting refrigerant vapor and any liquid refrigerant overflow from the storage container back to the refrigeration system through the vent hosing;

deactivating the pump;

closing the drain hosing valve and disconnecting the drain hosing from the storage container by disconnecting the pair of fittings of the quick disconnect coupling and further disconnecting the vent hosing from the storage container;

coupling the drain hosing and vent hosing with a second storage container and opening the drain hosing valve; and reactivating the pump to transfer liquid refrigerant from the system into the second storage container.

2. The method of clami 1 wherein the method comprises, in response to the activation step, the step of pumping a low pressure chlorofluorocarbon liquid refrigerant between the system and the storage container.

3. A method of environmentally safely transferring low-pressure liquid refrigerant between a closed refrigeration system and a transportable, liquid refrigerant storage container, the refrigeration system including a drain valve and drain fitting located below a normal level of liquid refrigerant in the system and a fill valve and fill fitting located above the normal level of liquid refrigerant in the system, the liquid refrigerant storage container including at least two separate fittings providing separate access to the container interior, comprising the steps of:

sealingly coupling a liquid refrigerant pump between the drain fitting and one of the two storage container fittings through drain hosing, sealingly coupling the remaining one of the two storage container fittings and the refrigeration system fill fitting through vent hosing, and opening the system drain and fill valves;

activating the pump to transfer low-pressure liquid refrigerant from the system through the drain hosing into the storage container;

conducting refrigerant vapor and any liquid refrigerant overflow from the storage container back to the refrigeration system through the vent hosing;

reversing the direction of the pump action; and reactivating the pump to transfer the liquid refrigerant from the storage container to the refrigeration system through the drain hosing.

4. The method of claim 3 wherein the pump includes an inlet and an outlet and the drain hosing comprises a first hose coupling the pump inlet to the drain fitting and a second hose coupling the pump outlet to the storage container during the activating and conducting steps and wherein the steps of reversing the diretion of pump action comprises coupling the pump inlet to the storage container with the second hose and the pump outlet to the drain fitting with the first hose.

5. The method of claim 4 wherein liquid refrigerant is transferred at a rate up to about thirty pounds per minute during the activation and reactivation steps.

6. The method of claim 4 wherein undistilled and unfiltered liquid refrigerant is transferred to the refrigeration system through the drain hose from the storage container during the reactivating step.

7. A method of environmentally safely transferring liquid refrigerant between a low pressure side of a closed refrigeration system and a transportable, liquid refrigerant storage container, the low pressure side of the refrigeration system including a drain valve and drain fitting located below a normal level of liquid refrigerant in the low pressure side of the system and a fill valve and fill fitting located above the normal level of liquid refrigerant storage container including at least two separate fittings providing separate access to the container interior, comprising the steps of:

sealingly coupling a liquid refrigerant pump between the drain fitting and one of the two storage container fittings through drain hosing, sealingly coupling the remaining one of the two storage container fittings and the refrigeration system fill fitting through vent hosing, and opening the system drain and fill valves;

activating the pump to transfer liquid refrigerant from the low pressure side of the system through the drain hosing into the storage container;

conducting refrigerant vapor and any liquid refrigerant overflow from the storage container back to the low pressure side of the refrigeration system through the vent hosing simultaneously with the transfer of low-pressure liquid refrigerant into the storage container, the liquid refrigerant being transferred and the refrigerant vapor and any liquid refrigerant overflow being conducted without filtration or distillation;

reversing the direction of the pump action; and activating the pump to transfer unfiltered and undistilled liquid refrigerant in the storage container to the closed refrigeration system.

8. The method of claim 7 further comprising the steps of:

deactivating the pump;

disconnecting the drain hosing and vent hosing from the storage container;

coupling the drain hosing and vent hosing with a second storage container; and reactivating the pump to transfer liquid refrigerant from the system into the second storage container.

9. A method of environmentally safely transferring liquid refrigerant between a closed refrigeration system and a transportable, liquid refrigerant storage container, the refrigeration system including a drain valve and drain fitting located below a normal level of low-pressure liquid refrigerant in the system and a fill valve and fill fitting located above the normal level of low-pressure liquid refrigerant in the system, the liquid refrigerant storage container including at least two separate fittings providing separate access to the container interior, comprising the steps of:

sealingly coupling a liquid refrigerant pump between the drain fitting and one of the two storage container fittings through drain hosing, the drain hosing including a shut-off valve, sealingly coupling the remaining one of the two storage container fittings and the refrigeration system fill fitting through vent hosing, and opening the system drain and fill valves;

activating the pump to transfer low-pressure liquid refrigerant from the system through the drain hosing into the storage container;

conducting refrigerant vapor and any liquid refrigerant overflow from the storage container back to the refrigeration system through the vent hosing;

deactivating the pump;

closing the drain hosing valve and disconnecting the drain hosing and vent hosing from the storage container;

coupling the drain hosing and vent hosing with a second storage container and opening the drain hosing valve;

reactivating the pump to transfer liquid refrigerant from the system into the second storage container;

reversing the direction of the pump action; and activating the pump to transfer the liquid refrigerant in one of the storage containers from the one storage container to the refrigeration system.

* * * * *